US011758995B2

(12) United States Patent
Elias

(10) Patent No.: US 11,758,995 B2
(45) **Date of Patent: *Sep. 19, 2023**

(54) KEY RING ACCESSORY DEVICES

(71) Applicant: Key-Ker Clip Ltd., Tel Aviv (IL)

(72) Inventor: Amir Elias, Ramat Hasharon (IL)

(73) Assignee: Key-Ker Clip Ltd., Tel Aviv (IL)

( * ) Notice: Subject to any disclaimer, the term of this patent is extended or adjusted under 35 U.S.C. 154(b) by 0 days.

This patent is subject to a terminal disclaimer.

(21) Appl. No.: 17/712,151

(22) Filed: Apr. 3, 2022

(65) Prior Publication Data

US 2022/0218085 A1 Jul. 14, 2022

Related U.S. Application Data

(63) Continuation-in-part of application No. 16/481,706, filed as application No. PCT/IL2018/050123 on Feb. 4, 2018, now Pat. No. 11,291,289.

(30) Foreign Application Priority Data

Feb. 5, 2017 (IL) ..... 250458

(51) Int. Cl.
*A45C 11/00* (2006.01)
*A45C 13/00* (2006.01)
*A45F 5/02* (2006.01)

(52) U.S. Cl.
CPC ..... *A45C 11/00* (2013.01); *A45F 5/02* (2013.01); *A45C 13/005* (2013.01)

(58) Field of Classification Search
CPC ... A45F 5/02; A45F 2200/0558; A47G 29/10; A45C 11/32; A45C 11/321; A45C 2001/026; A45C 11/00; A45C 13/005
See application file for complete search history.

(56) References Cited

U.S. PATENT DOCUMENTS 1,473,361 A * 11/1923 Tebbetts ..... A45F 5/02 24/3.12
1,525,849 A * 2/1925 Buxton ..... A45C 11/323 206/37.6
2,468,959 A * 5/1949 Cannon ..... A45C 11/324 7/168
3,092,244 A * 6/1963 McWhirter ..... A45C 11/321 206/234
3,955,725 A * 5/1976 Rese ..... A45F 5/00 224/245
5,113,602 A * 5/1992 Levine ..... G09F 3/08 40/330

(Continued)

*Primary Examiner* — Robert Sandy
*Assistant Examiner* — Rowland Do
(74) *Attorney, Agent, or Firm* — Dekel Patent Ltd; David Klein

(57) ABSTRACT

Key ring accessory devices enable a user to conveniently and repeatedly attach an accessory item to a key ring's split ring and detach it therefrom and, during its detachment, securely clamp the accessory item to a clothing item for safely carrying the accessory item. The key ring accessory devices include a spring clip with the interchangeability functionality of freely and directly suspending an accessory item from a key ring's split ring and clamping the accessory item on a clothing item. The key ring accessory devices are designed such that they are unable to merely slide off a split ring but rather requires a specific user manipulation.

11 Claims, 16 Drawing Sheets

(56) References Cited

U.S. PATENT DOCUMENTS

| | | | | | |
|---|---|---|---|---|---|
| 5,181,927 | A * | 1/1993 | Song | E05B 19/24 | 362/116 |
| 5,365,760 | A * | 11/1994 | Song | E05B 19/00 | 70/460 |
| 5,768,924 | A * | 6/1998 | Song | A45C 13/023 | 70/408 |
| D575,054 | S * | 8/2008 | Walcott | D3/208 | |
| 2011/0302970 | A1* | 12/2011 | Amron | E05B 19/04 | 70/456 R |
| 2015/0059937 | A1* | 3/2015 | Singer | A45C 1/06 | 206/38.1 |

* cited by examiner

KEY RING ACCESSORY DEVICES

FIELD OF THE INVENTION

This invention relates to key ring accessory devices.

BACKGROUND OF THE INVENTION

People tend to attach their everyday accessory items, for example, an electronic chip tag for providing access to a facility, a disk on key, a tracking chip, a runner's LED light, a bottle opener and the like, to a key ring. Key rings include a split ring enabling a person to attach an accessory item thereonto and remove it therefrom. Such attachment and detachment require considerable dexterity and is time wasting. Key rings are unwieldy during a wide range of human activities such that many people tend to tiresomely detach an accessory item from a key ring before an activity and hold it or carry it on their person before re-attaching it to the key ring after the activity. Holding or carrying an accessory item during an activity is also problematic and can often lead to its loss.

SUMMARY OF THE INVENTION

The present invention is directed towards key ring accessory devices for enabling a user to conveniently interchangeably attach an accessory item to a key ring's split ring and detach it therefrom and, during its detachment, securely clip the accessory item onto a clothing item's hem, a shoe, and the like, for safely carrying the accessory item. The key ring accessory devices include a spring clip designed such that an accessory item can be freely suspended from a key ring's split ring as if it was directly and freely suspended therefrom. The key ring accessory devices are designed such that it is unable to merely slide off a split ring but rather requires a specific user manipulation to prevent inadvertent detachment. The specific user manipulation can be readily learnt and requires less time and dexterity than for present attachment of an accessory item to a split ring and detachment therefrom. The key ring accessory devices are also designed to prevent an accessory item from repeatedly lightly hitting a user's body during a sport activity, for example, running.

Key ring accessory devices of the present invention can be implemented either with a housing for entrapping a discrete accessory item or integrally form with an accessory item. Housings can be implemented as follows: First, a housing having a slot for enabling sliding insertion of a discrete accessory item into the housing. Second, a dual component housing can include a discrete first housing component and a discrete second housing component for mounting on the discrete first housing component for entrapping a discrete accessory item in the dual component housing. Third, a flip housing having a first housing component and a second housing component hingedly mounted on the first housing component for entrapping a discrete accessory item in the flip housing. And fourthly, a housing can include a housing surface with a resiliently flexible rim for peripherally securing a discrete accessory item in the housing.

Key ring accessory devices of the present invention preferably include a constraining arrangement for entrapping a clamping section therebetween and thereby constrain movement of the clamping section towards said base member front surface and away therefrom, as opposed to a sideways movement. Key ring accessory devices of the present invention preferably include a grip feature for gripping a clothing item.

BRIEF DESCRIPTION OF THE DRAWINGS

In order to understand the invention and to see how it can be carried out in practice, preferred embodiments will now be described, by way of non-limiting examples only, with reference to the accompanying drawings in which similar parts are likewise numbered, and in which:

FIG. 16 is a pictorial view of an integral spring clip with accessory item including a remote control and the like;

FIG. 17 is a pictorial view of an integral spring clip with accessory item including a flash drive and the like;

DETAILED DESCRIPTION OF THE DRAWINGS

Overview

Figure 1A:
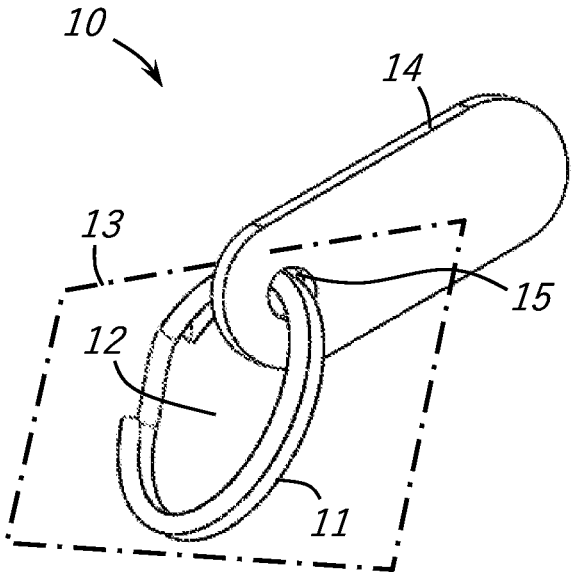
FIG. 1A is a pictorial view of a key ring having a split ring and a tag.
Figure 1B:
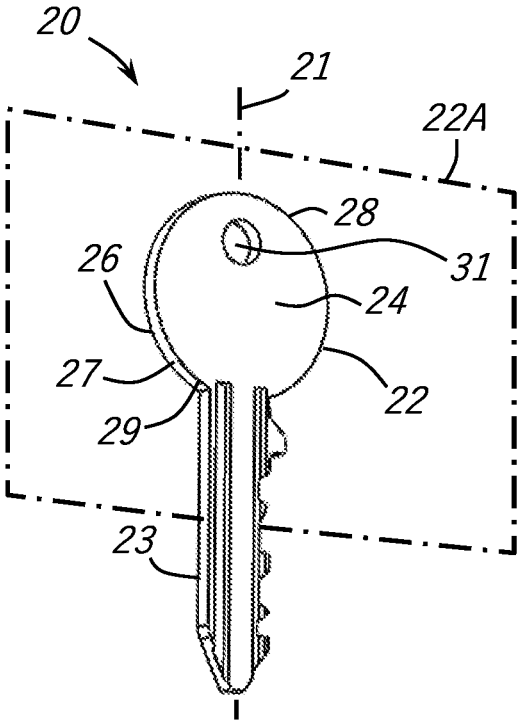
FIG. 1B is a pictorial view of a standard key having a throughgoing bore for attaching the key to a key ring's split ring.
Figure 1C:
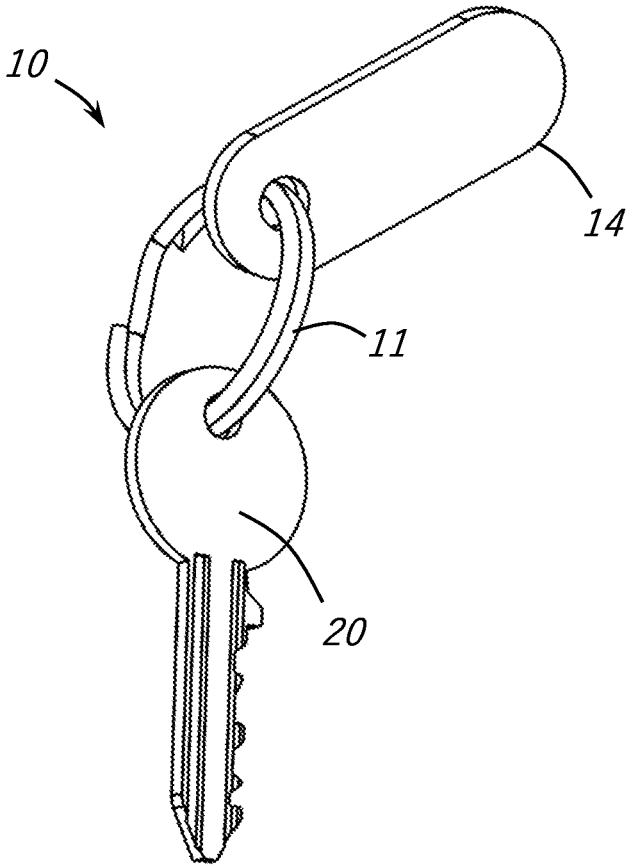
FIG. 1C is a pictorial view of the key ring with the key and a tag freely and directly suspended therefrom.

FIG. 1A shows a key ring 10 having a split ring 11 bounding a split ring aperture 12 having a split ring aperture plane 13 and a key ring tag 14 attached to the split ring 11. The key ring tag 14 has a throughgoing bore 15 for enabling threading the key ring's split ring 11 onto the key ring tag 14. The key ring tag 14 can be detached from the split ring 11 by operating the split ring 11. FIG. 1B shows a standard key 20, for example, a house key, a car ignition key, and the like. The key 20 has a longitudinal key centerline 21 and includes a generally planar keyhead 22 and a keyshank 23. The keyhead 22 has a keyhead plane 22A and can have a generally rectangular shape, a generally circular shape, a generally triangular shape, and the like. The keyhead 22 has a keyhead front surface 24, a keyhead back surface 26, and a keyhead peripheral surface 27. The keyhead peripheral surface 27 has a trailing keyhead peripheral surface 28 and a leading keyhead peripheral surface 29 with the keyshank 23 extending therefrom along the longitudinal key centerline 21. The keyhead 22 has a throughgoing bore 31 for enabling threading the key ring's split ring 11 onto the key 20. FIG. 1C shows the key 20 being freely suspended from the split ring 11 such that the keyhead plane 22A traverses the split ring aperture plane 13 and being typically transverse thereto.

Figure 2:
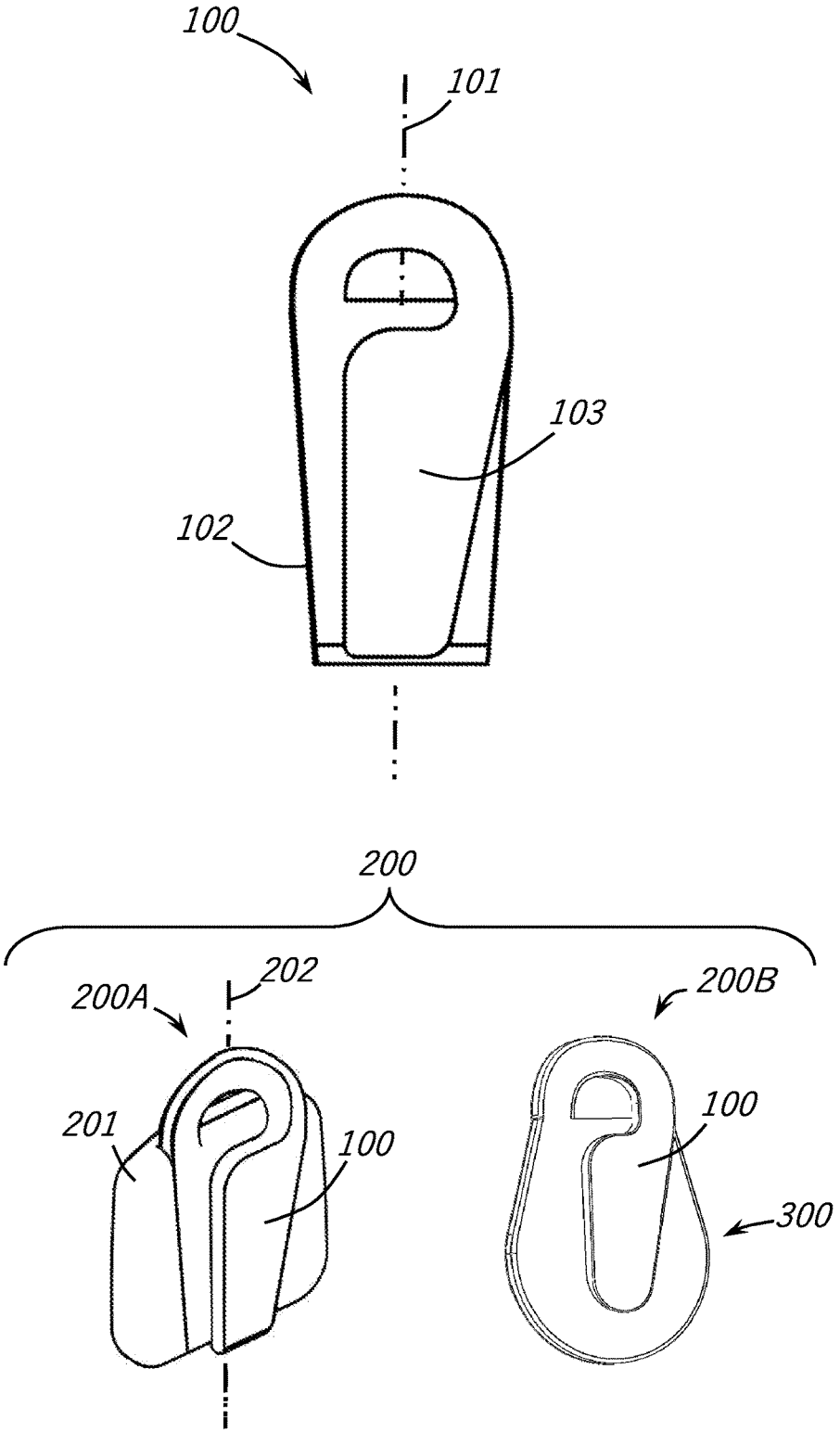
FIG. 2 is a pictorial view of two implementations of key ring accessory devices having a common spring clip.
Figure 3:
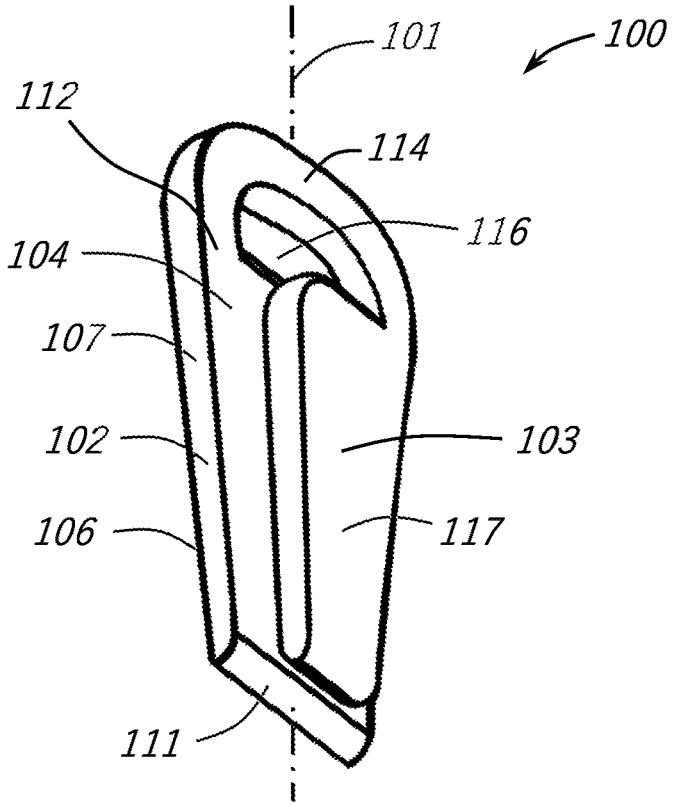
FIG. 3 is a front bottom perspective view of the spring clip.
Figure 4:
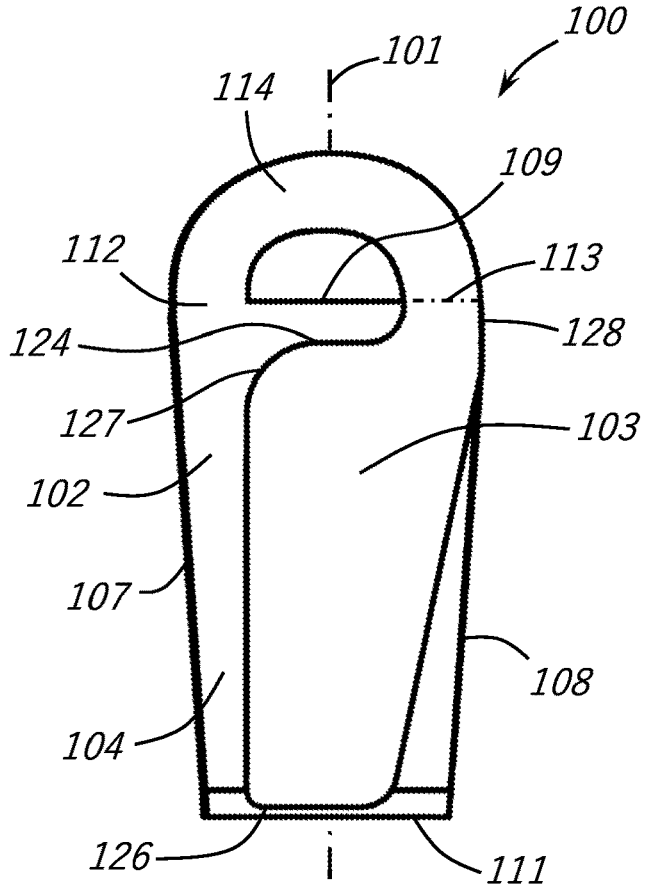
FIG. 4 is a front elevation view of the spring clip.
Figure 5A:
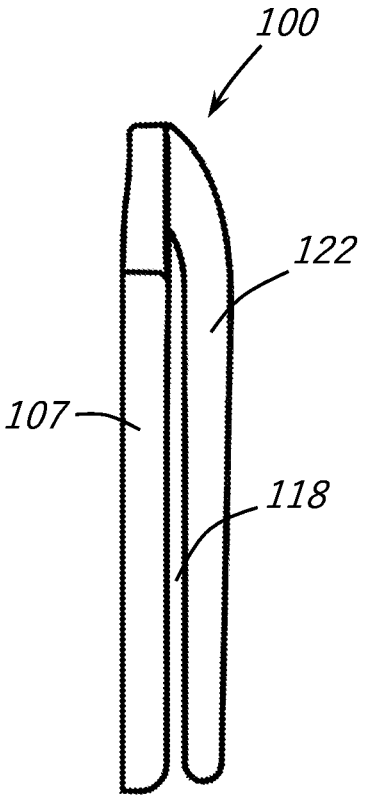
FIG. 5A is a left side elevation view of the spring clip.
Figure 5B:
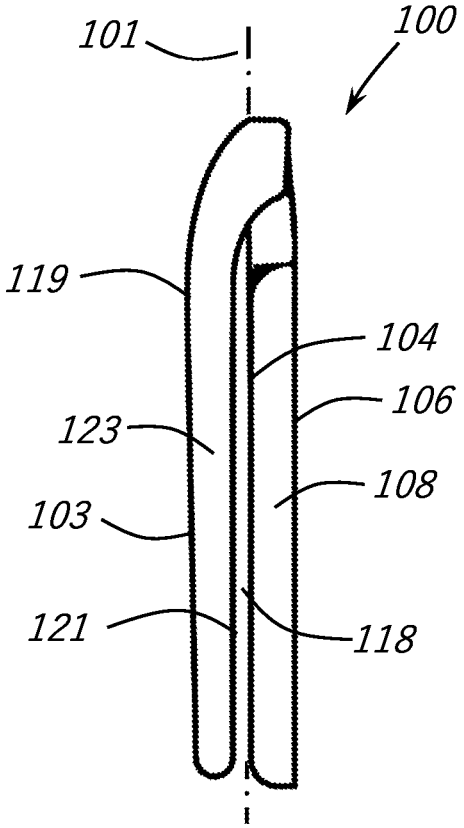
FIG. 5B is a right side elevation view of the spring clip.
Figure 6:
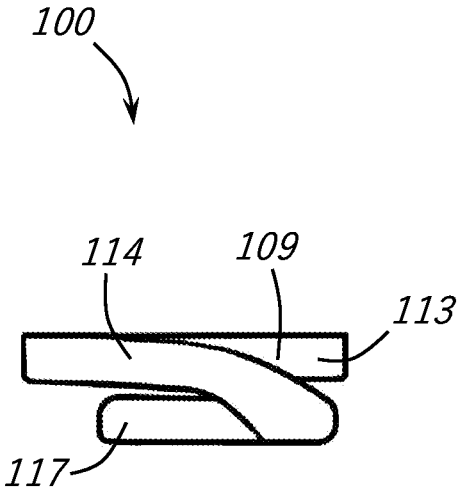
FIG. 6 is a top plan view of the spring clip.

FIG. 2 shows a spring clip 100 has a longitudinal spring clip centerline 101 and includes an elongated planar base member 102 and a clamping member 103 resiliently flexibly mounted on the base member 102 for forming a clamping zone therebetween and preventing the spring clip 100 from inadvertently being detached from the split ring 11. The spring clip 100 can be integrally formed in two types of key ring accessory devices 200 as follows: a key ring accessory device 200A including a housing 201 for entrapping a discrete accessory item 300 or a key ring accessory device 200B integrally formed with an accessory item 300. The housing 201 has a longitudinal housing centerline 202 co-directional with the longitudinal spring clip centerline 101.

Spring Clip

FIG. 3 to FIG. 6 show the spring clip 100 has the spring clip centerline 101 and includes the elongated planar base member 102 and the clamping member 103. The spring clip 100 is formed from suitable resiliently flexible material including inter alia metal, plastic, silicon, rubber, and the like. The base member 102 includes a base member front surface 104, a base member back surface 106, pair of opposite base member major side surfaces 107 and 108 co-directional with the longitudinal spring clip centerline 101, and a base member uppermost side surface 109 transverse to the longitudinal spring clip centerline 101 and an opposite base member lowermost side surface 111 transverse to the longitudinal spring clip centerline 101. The base member uppermost side surface 109 has spaced apart base member uppermost side surface ends including a base member uppermost side surface first end 112 on one side of the longitudinal spring clip centerline 101 and an opposite base member uppermost side surface second end 113 on the other side of the longitudinal spring clip centerline 101 in a front elevation view of the spring clip 100.

The clamping member 103 includes a bridge section 114 which outwardly extends with respect to the base member uppermost side surface 109 from the base member uppermost side surface first end 112 towards the base member uppermost side surface second end 113 to bound a throughgoing retaining aperture 116 substantially co-planar with the base member 102. The clamping member 103 includes an elongated planar clamping section 117 extending from the bridge section 114 co-directional with the longitudinal spring clip centerline 101 to overlie the base member front surface 104 to form a clamping zone 118 therebetween. The clamping section 117 is viewable in the spring clip 100's front elevation view thereby concealing the clamping zone 118 therebehind. The throughgoing retaining aperture 116 is spaced apart from the clamping zone 118 and has a closed shape in the spring clip 100's front elevation view.

The elongated planar clamping section 117 includes a clamping section front surface 119, a clamping section back surface 121 facing the base member front surface 104, opposite clamping section side surfaces 122 and 123 co-directional with the longitudinal spring clip centerline 101, and a clamping section uppermost side surface 124 transverse to the longitudinal spring clip centerline 101 and an opposite clamping section lowermost side surface 126 transverse to the longitudinal spring clip centerline 101. The clamping section uppermost side surface 124 is substantially co-extensive with the throughgoing retaining aperture 116. The clamping section uppermost side surface 124 has spaced apart clamping section uppermost side surface ends including a clamping section uppermost side surface first end 127 on the same side of the longitudinal spring clip centerline 101 as the base member uppermost side surface first end 112 and an opposite clamping section uppermost side surface second end 128 on the same side of the longitudinal spring clip centerline 101 as the base member uppermost side surface second end 113 in the spring clip 100's front elevation view.

Housings

FIG. 7A to FIG. 7D show key ring accessory devices 200A with four different housings 201 for entrapping a discrete accessory item 300. The housings 201 include the longitudinal housing centerline 202, a housing front surface 203, a housing back surface 204, a housing major side surface 206 co-directional with the longitudinal housing centerline 202, a housing major side surface 207 co-directional with the longitudinal housing centerline 202, a housing uppermost side surface 208 transverse to the longitudinal housing centerline 202 and a housing lowermost side surface 209 transverse to the longitudinal housing centerline 202. The housings 201 can include closure elements for preventing inadvertent opening of a housing. Suitable closure elements include magnetic fastenings, snap fits, zippers, and the like.

Figure 7A:
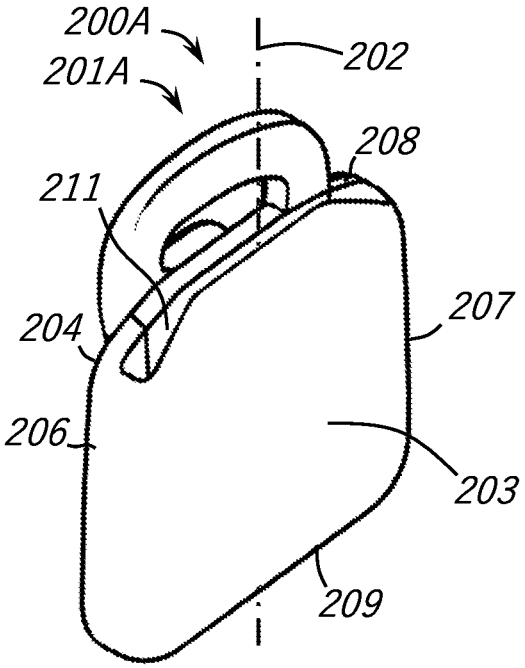
FIG. 7A is a pictorial view of a key ring accessory device including a housing having a slot.
Figure 7B:
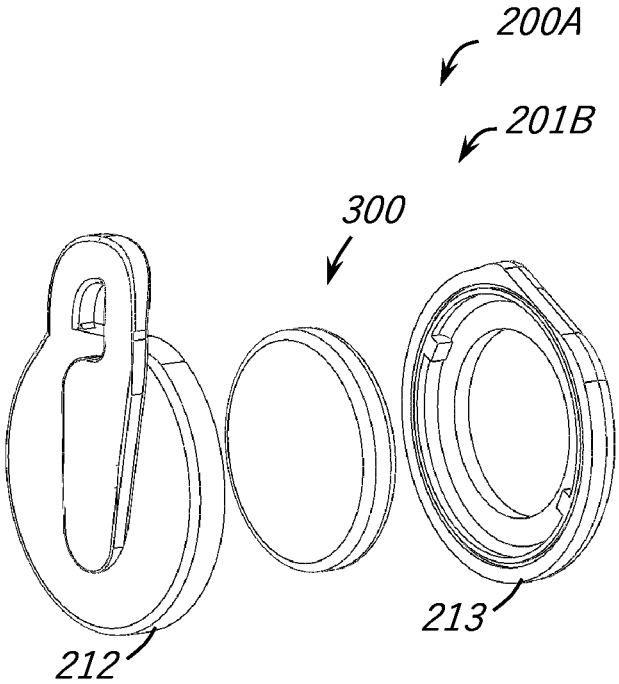
FIG. 7B is a pictorial view of a key ring accessory device including a dual component housing.
Figure 7C:
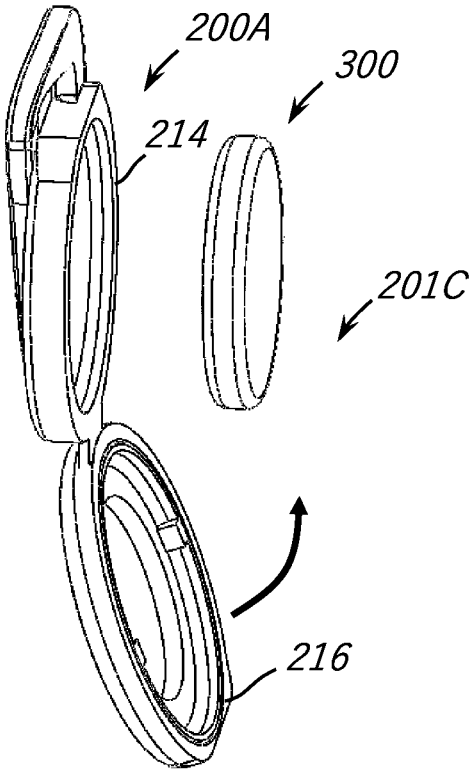
FIG. 7C is a pictorial view of a key ring accessory device including a flip housing.
Figure 7D:
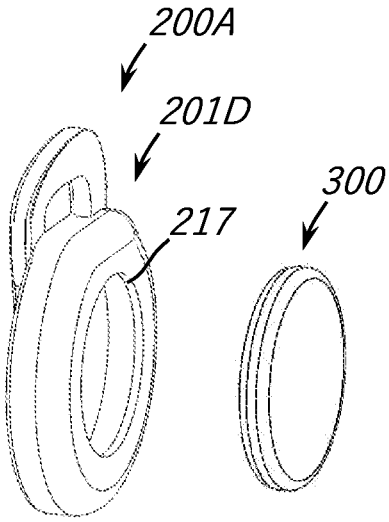
FIG. 7D is a pictorial view of a key ring accessory device including a housing having a front housing surface with a resiliently flexible rim for securing an accessory item.

FIG. 7A shows a key ring accessory device 200A including a housing 201A having a slot 211 in the housing uppermost side surface 208. Alternatively, the housing 201A can be formed with a slot 211 in one of its housing major side surfaces 206 and 207 or in its lowermost side surface 209. FIG. 7B shows a key ring accessory device 200A including a dual component housing 201B having a discrete first housing component 212 and a discrete second housing component 213 for mounting on the first housing component 212 for entrapping a discrete accessory item 300 in the dual component housing 201B. FIG. 7C shows a key ring accessory device 200A including a flip housing 201C having a first housing component 214 and a second housing component 216 hingedly mounted on the first housing component 214 for entrapping a discrete accessory item 300 in the flip housing 201C. FIG. 7D shows a key ring accessory device 200A including a housing 201D having a housing front surface 203 with a resiliently flexible rim 217 for peripherally securing a discrete accessory item 300 in the housing 201D. The resiliently flexible rim 217 can bound different shapes such as a circle, a square, an ellipsoid, a star, and the like and can alternatively be located on other surfaces of the key ring accessory device 201D.

Figure 8A:
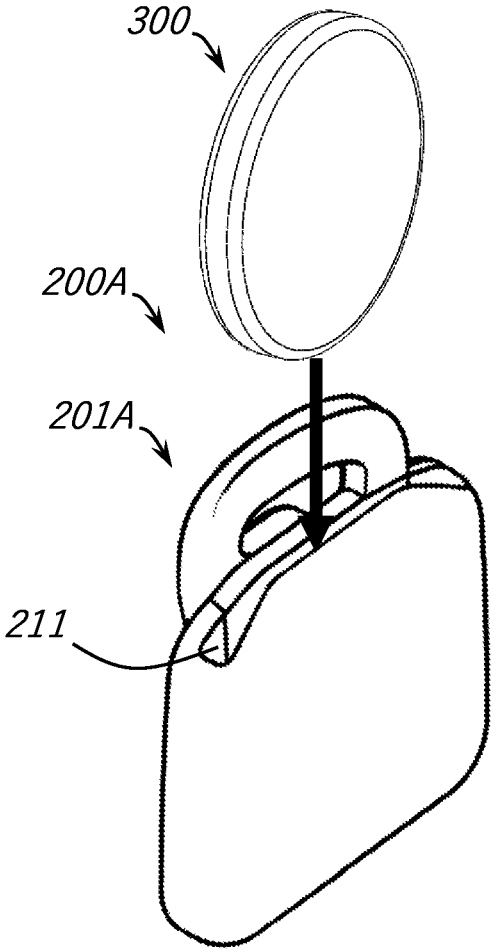
FIG. 8A and FIG. 8B show a user inserting an accessory item into the FIG. 7A key ring accessory device's housing.
Figure 8B:
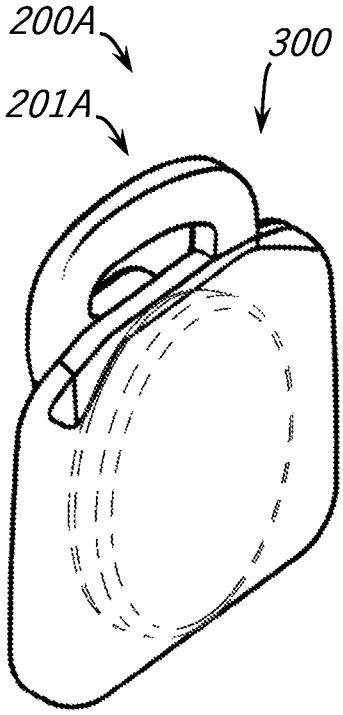

FIG. 8A and FIG. 8B show a user slidingly inserting a discrete accessory item 300 through the slot 211 into the housing 201A.

Use of Key Ring Accessory Device

Figure 9A:
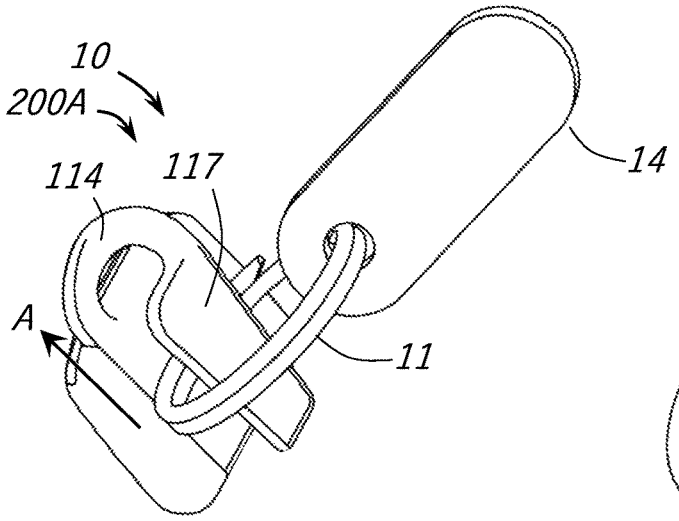
FIG. 9A, FIG. 9B and FIG. 9C show a user attaching the FIG. 7A key ring accessory device to a key ring's split ring.
Figure 9B:
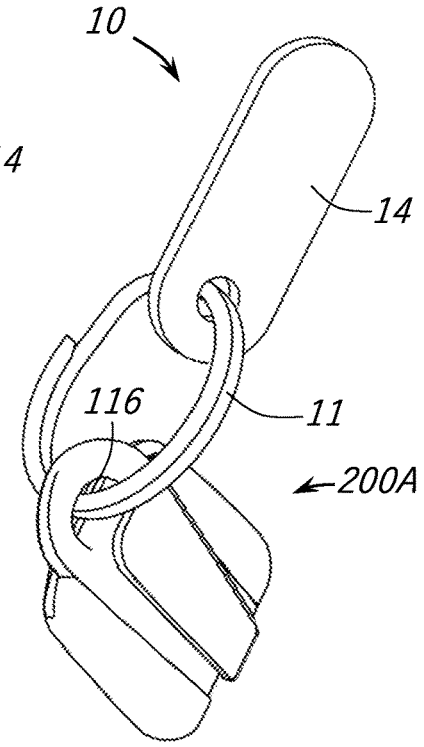
Figure 9C:
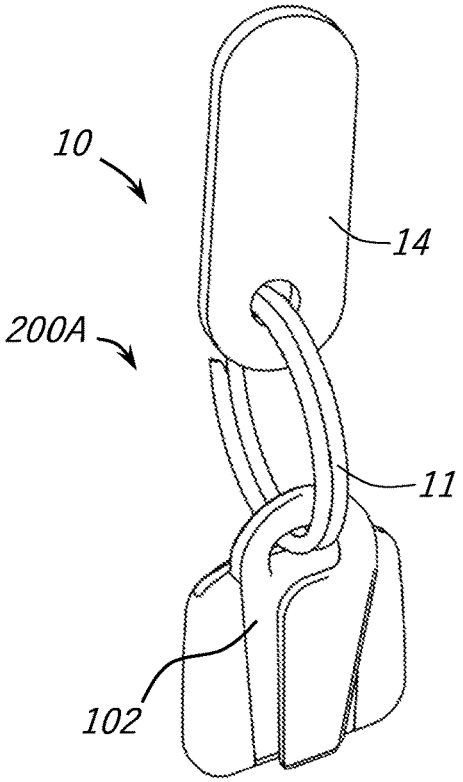
Figure 10:
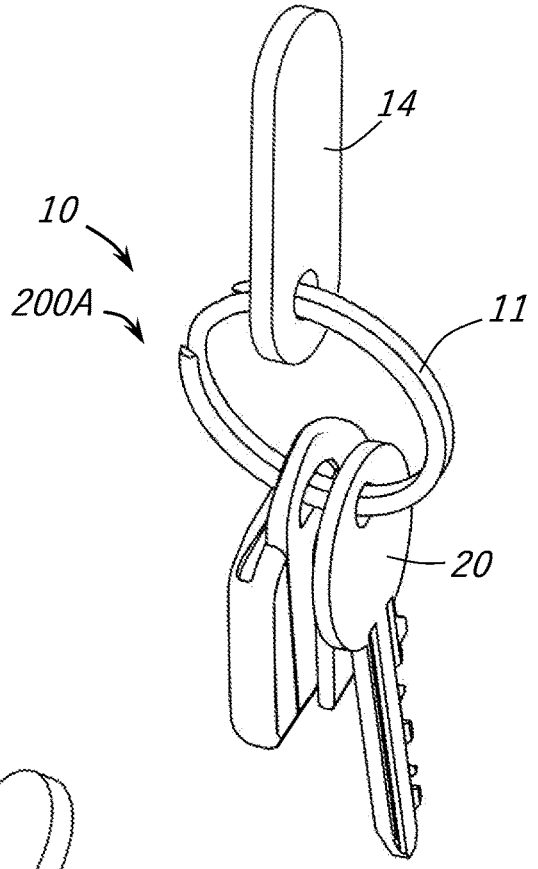
FIG. 10 is a pictorial view of a key ring with the FIG. 7A key ring accessory device and a standard key freely and directly suspended therefrom.

FIG. 9A to FIG. 9C show a user attaching the key ring accessory device 200A onto a key ring's split ring 11 as follows: FIG. 9A shows the user slidingly inserting the split ring 11 between the elongated planar base member 102 and the clamping section 117 through the clamping zone 118 towards the bridge section 114 as denoted by arrow A by elastically deforming the bridge section 114. FIG. 9B shows the user slidingly inserting the split ring 11 into the throughgoing retaining aperture 116 whereupon the bridge section 114 reverts to its non-deformed shape. FIG. 9C shows the key ring accessory device 200A suspended from the key ring 10 such that the base member 102 is traverse to the split ring aperture plane 13 to assume the same position as a standard key 20 (see FIG. 1C). FIG. 10 shows the key ring accessory device 200A aligned with a standard key 20 with the base member 102 traversing the split ring aperture plane 13.

Figure 11A:
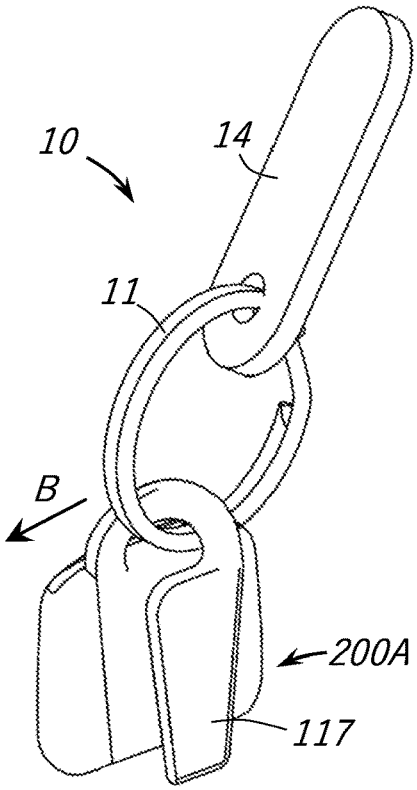
FIG. 11A and FIG. 11B show a user detaching the FIG. 7A key ring accessory device from a key ring's split ring.
Figure 11B:
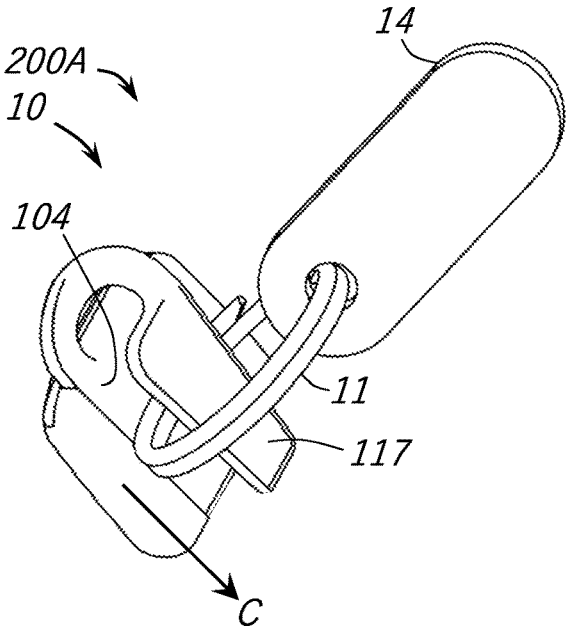

FIG. 11A and FIG. 11B show a user detaching the key ring accessory device 200A from the key ring's split ring 11. FIG. 11A shows the user sliding the split ring 11 towards the base member uppermost side surface second end 113 and then directing the split ring 11 through the clamping zone 118 while applying the split ring 11 to elastically deform the bridge section 114 at its juncture with the clamping section 117 such that the user can urge the split ring 11 out of the throughgoing retaining aperture 116 as denoted by arrow B. Such a simultaneous double-action manipulation of the split ring 11 out of the throughgoing retaining aperture 116 precludes inadvertent detachment of the key ring accessory device 200A from the split ring 11. FIG. 11B shows the user sliding the split ring 11 between the base member front surface 104 and the clamping section 117 towards the base member lowermost side surface 111 as denoted by arrow C until the key ring accessory device 200A is detached from the split ring 11.

Figure 12A:
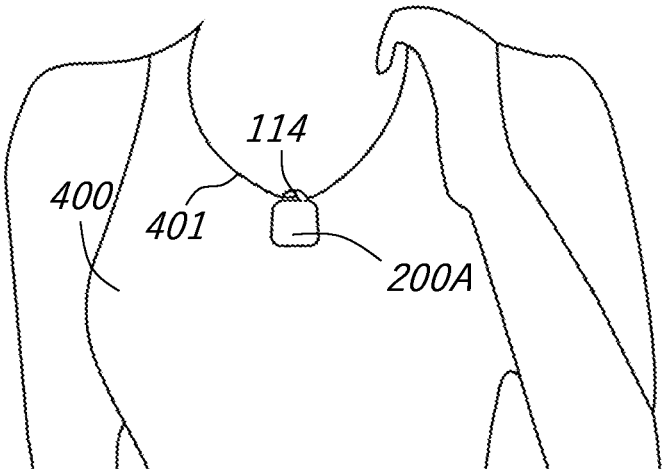
FIG. 12A is a pictorial view showing the FIG. 7A key ring accessory device clamped on a clothing item's hem.
Figure 12B:
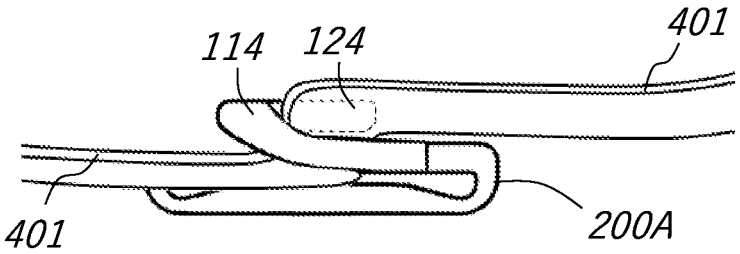
FIG. 12B is a top elevation view of FIG. 12A.

FIG. 12A and FIG. 12B show a user clamping the key ring accessory device 200A on a clothing item 400 having a clothing item hem 401 by slidingly inserting the clothing item hem 401 through the clamping zone 118 between the elongated planar base member 102 and the clamping member 103 towards the throughgoing retaining aperture 116. The clothing item hem 401 is preferably inserted towards the bridge section 114 such that the clothing item hem 401 extends lengthwise through the throughgoing retaining aperture 116 thereby overlying the clamping section uppermost side surface 124 shown in dashed lines. The clothing item hem 401 assumes a zigzag shape thereby ensuring a secure clamping.

Integral Spring Clip with Accessory Items

Figure 13:
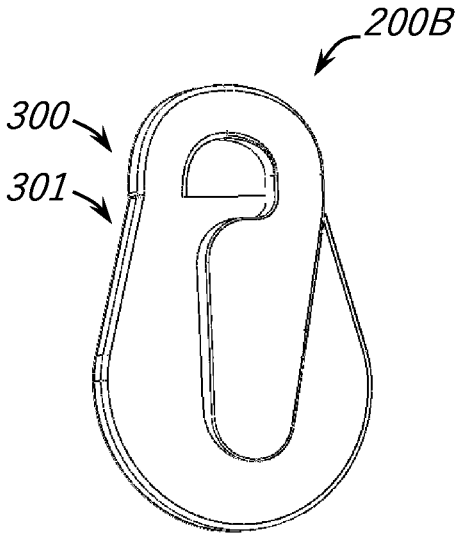
FIG. 13 is a pictorial view of an integral spring clip with accessory item including an electronic chip.
Figure 14:
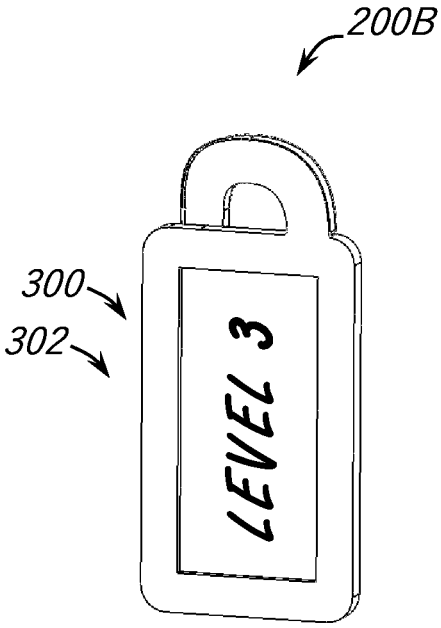
FIG. 14 is a pictorial view of an integral spring clip with accessory item including a tag.
Figure 15:
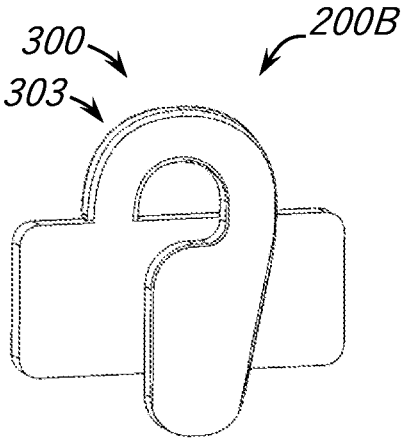
FIG. 15 is a pictorial view of an integral spring clip with accessory item including a pet tag.
Figure 16:
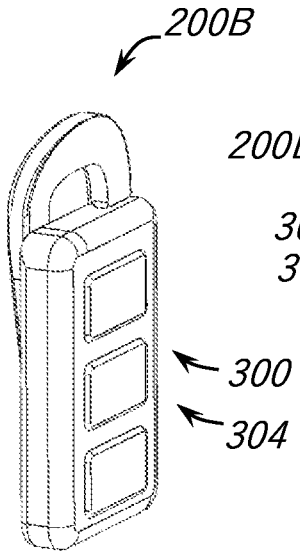
Figure 17:
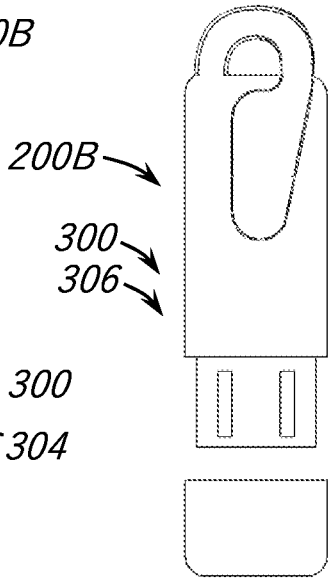
Figure 18:
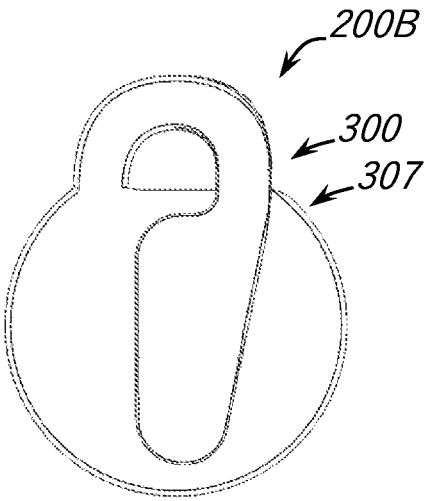
FIG. 18 is a pictorial view of an integral spring clip with accessory item including a tracker.
Figure 19:
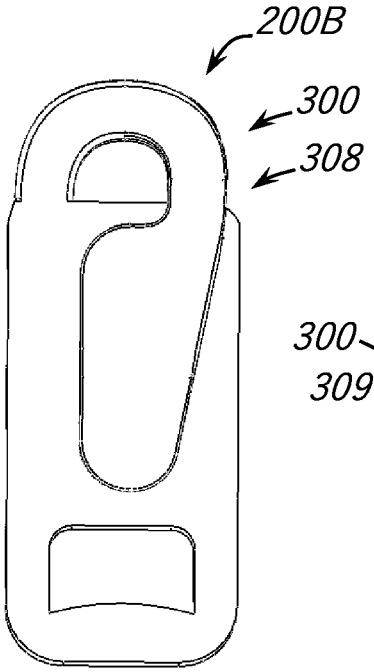
FIG. 19 is a pictorial view of an integral spring clip with accessory item including a bottle opener.
Figure 20:
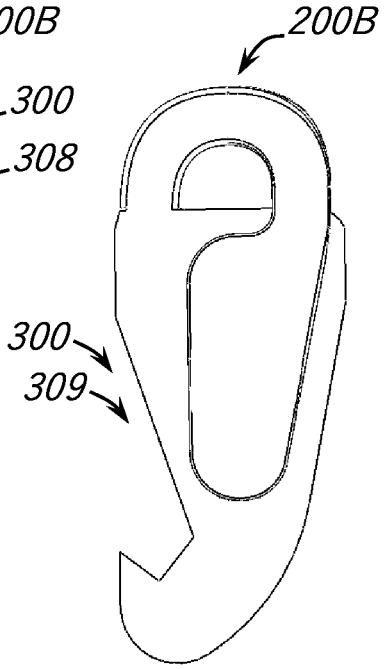
FIG. 20 is a pictorial view of an integral spring clip with accessory item including a can opener.
Figure 21:
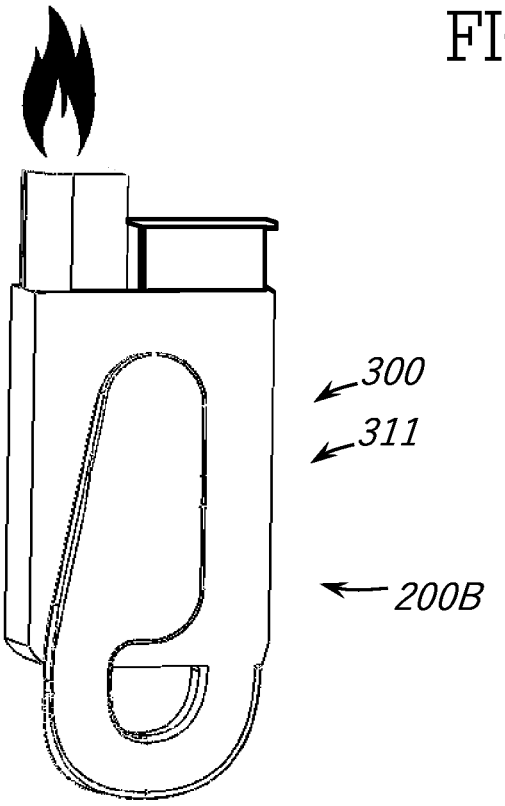
FIG. 21 is a pictorial view of an integral spring clip with accessory item including a lighter.
Figure 22:
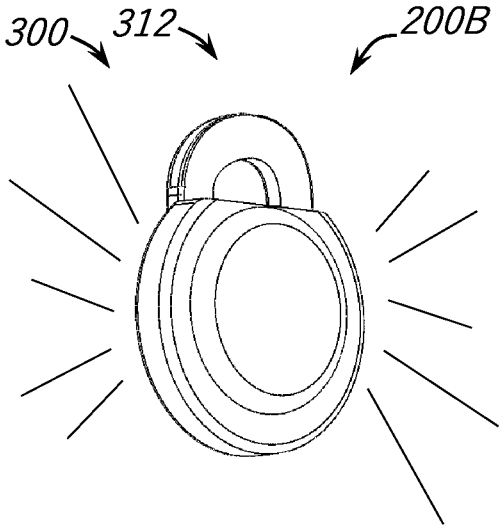
FIG. 22 is a pictorial view of an integral spring clip with accessory item including an electronic device.

FIG. 13 to FIG. 22 show integral spring clip with accessory items 200B with different accessory items 300 as follows: FIG. 13 shows an electronic chip 301 which can be constituted by a GPS chip, a money chip, an access entry chip, a digital wallet, a digital signature device, a RFID token, a NFC token, a minimarket cart release token, and the like. Exemplary access entry chips are now available for providing access to a secure facility, for example, an office block, a residence building, and the like. The electronic chip 301 can either require reader contact or be contactless. FIG. 14 shows a tag 302 similar to tag 14. FIG. 15 shows a pet tag 303. FIG. 16 shows a remote control 304 for opening a garage door, an external battery, a personal SOS alarm device and the like. FIG. 17 shows a flash drive 306 but alternatively can be a cold-storage device for cryptocurrency transactions and the likes. FIG. 18 shows a tracker 307. Suitable examples include inter alia Apple's AirTag. FIG. 19 shows a bottle opener 308. FIG. 20 shows a can opener 309 but alternatively can be a pocket tool such as a nail file and the likes, or a pocket tool with multiple functions. FIG. 21 shows a lighter 311. FIG. 22 shows an electronic device 312 in the form of an illumination device, a mini speaker, and the like.

ADDITIONAL EMBODIMENTS

For the purpose of conciseness, the additional embodiments are described with reference to the key ring accessory device 200A but they can be equally applied to the key ring accessory device 200B.

FIG. 23 to FIG. 28 show key ring accessory device 200A including a constraining arrangement 137 for entrapping the clamping section 117 therebetween and constrain the movement of the clamping section 117 towards a base member front surface 104 and away therefrom as opposed to a sideways movement with respect to the longitudinal spring clip centerline 101 in a front elevation view. Constraining arrangements 137 can be in the form of projections, recesses, or combinations thereof on a spring clip, a housing, or both a spring clip and a housing.

Figure 23:
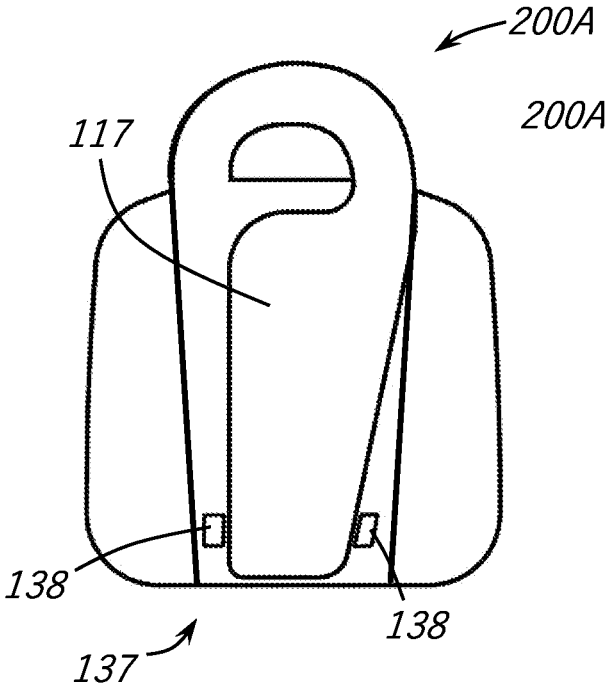
FIG. 23 to FIG. 26 are rear elevation views of a key ring accessory device with a constraining arrangement for constraining movement of the clamping section.
Figure 24:
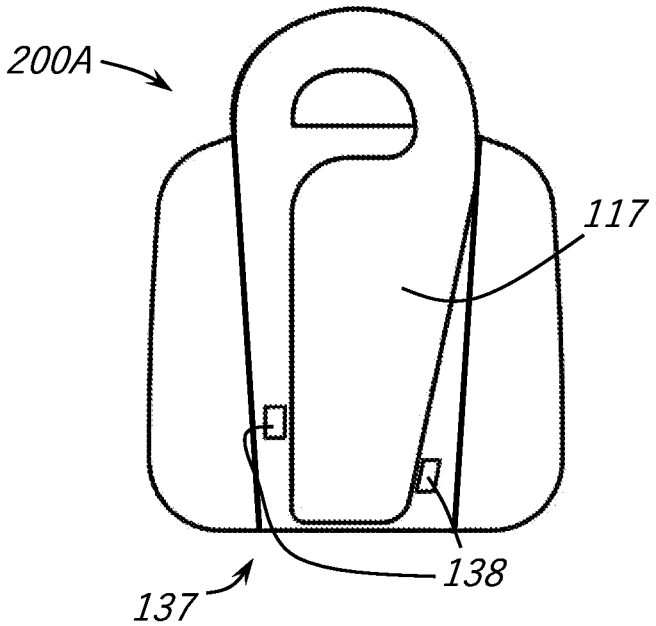

FIG. 23 and FIG. 24 show key ring accessory devices 200A each with a spaced apart pair of constraining projections 138 on the base member front surface 104 for entrapping the clamping section 117 therebetween. Accordingly, movement of the clamping section 117 is constrained towards the base member front surface 104 and away therefrom. FIG. 23 shows an opposite pair of constraining projections 138. FIG. 24 shows a staggered pair of constraining projections 138.

Figure 25:
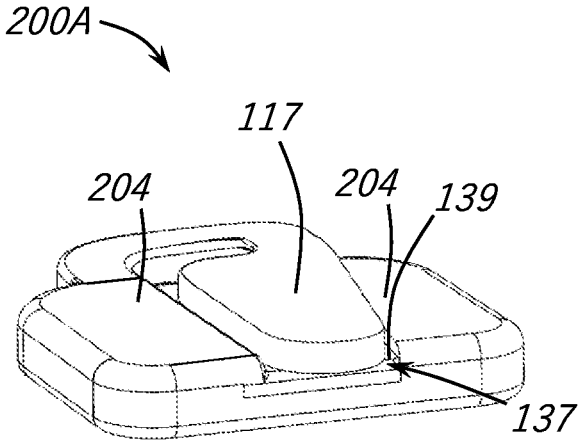
Figure 26:
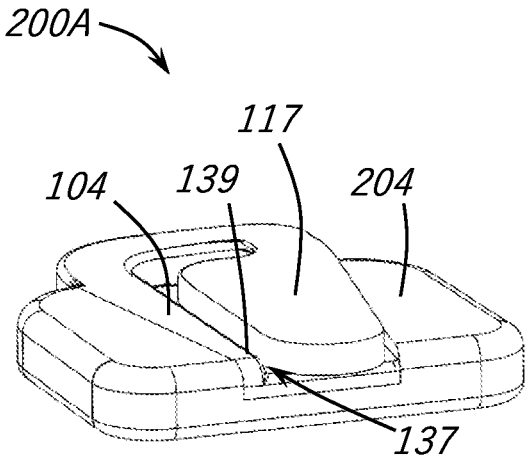

FIG. 25 and FIG. 26 show key ring accessory devices 200A each with a recess 139 for receiving the clamping section 117 thereby constraining movement of their clamping section 117 towards the base member front surface 104 and away therefrom. FIG. 25 shows the recess 139 is formed in the housing back surface 204. FIG. 26 shows the recess 139 is formed in the base member front surface 104 and the housing back surface 204.

Figure 27:
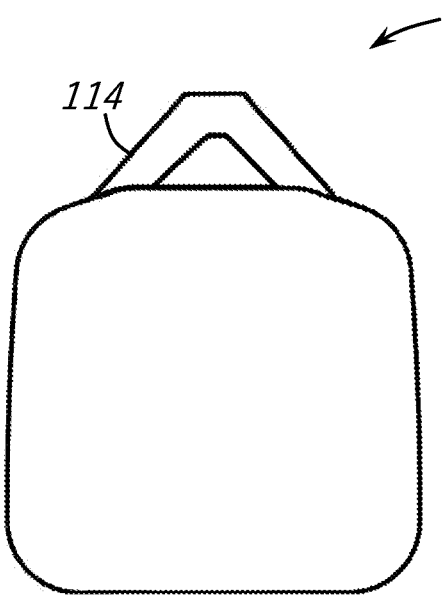
FIG. 27 is a front elevation view of a key ring accessory device including a trapezoidal shaped bridge section.
Figure 28:
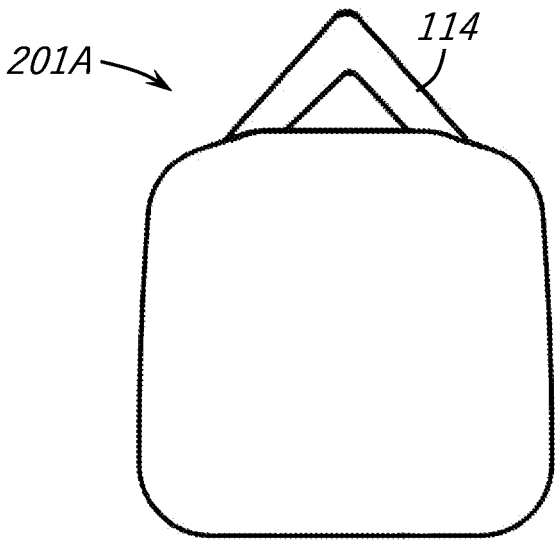
FIG. 28 is a front elevation view of a key ring accessory device including a triangular shaped bridge section.

FIG. 27 shows a housing 201A including a trapezoidal shaped bridge section 114 and FIG. 28 shows a housing 201A including a triangular shaped bridge section 114.

Figure 29:
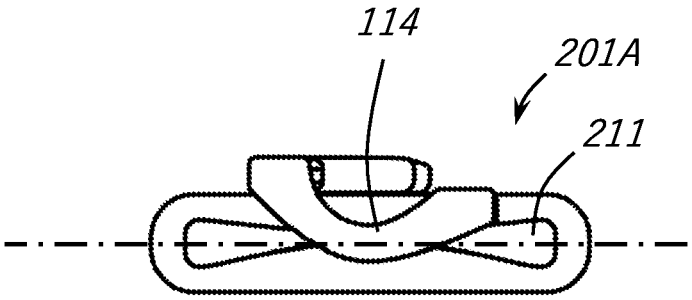
FIG. 29 is a top plan view of a key ring accessory device including a bridge section overlying a slot.

FIG. 29 shows a housing 201A including a bridge section 114 overlying its slot 211.

Figure 30:
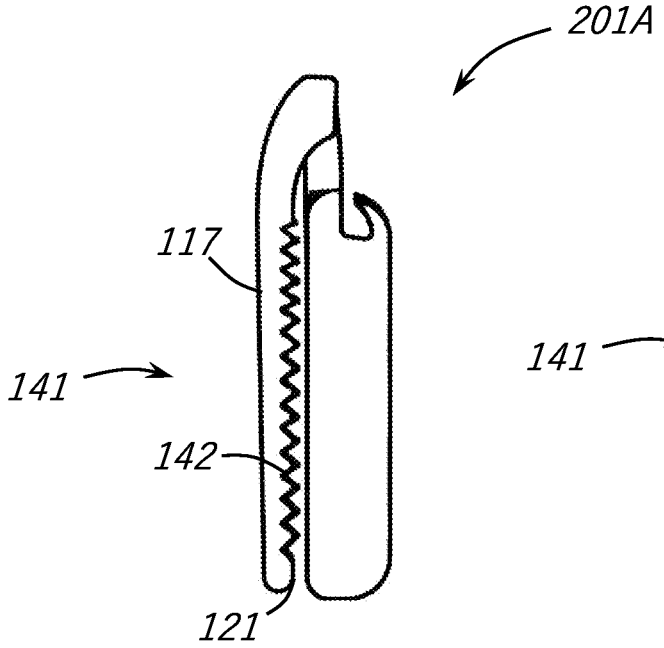
FIG. 30 to FIG. 33 are left side elevation views of key ring accessory devices including a grip feature for gripping a clothing item.
Figure 31:
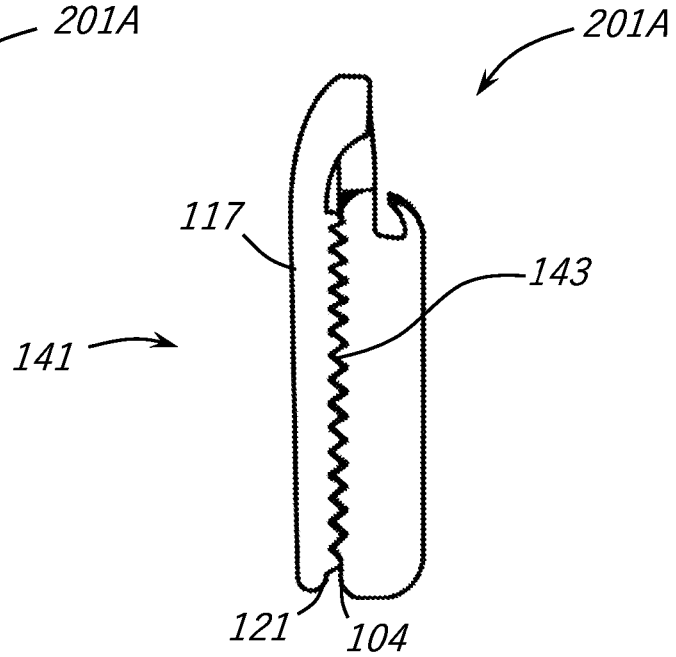
Figure 32:
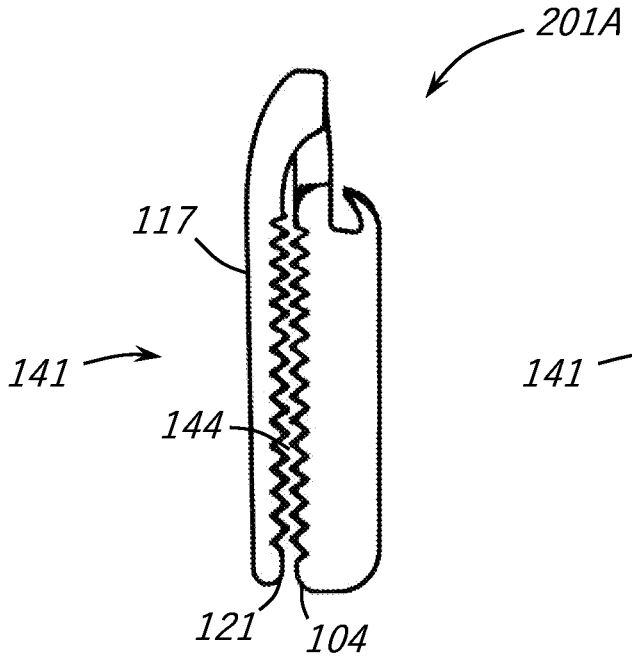
Figure 33:
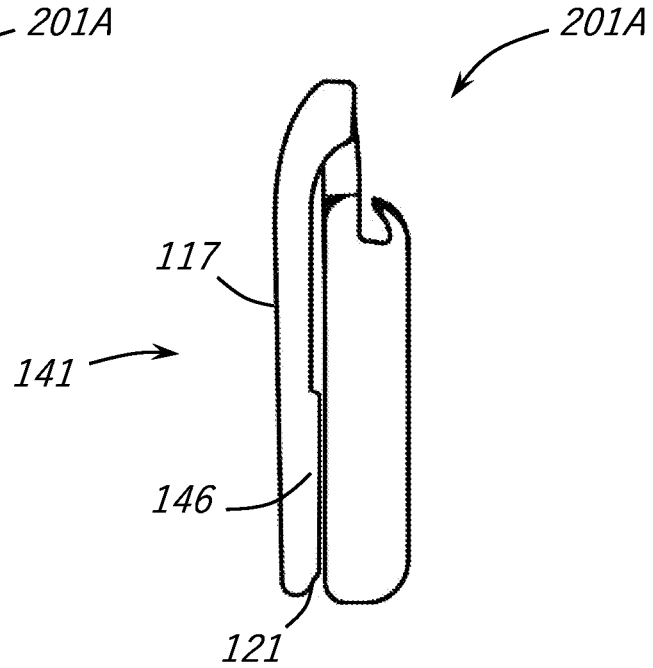

FIG. 30 to FIG. 33 show housings 201A including a clamping zone 118 with a grip feature 141 for gripping a clothing item. FIG. 30 shows the clamping section back surface 121 formed with a grip array 142 implementing the grip feature 141. FIG. 31 shows the base member front surface 104 and the clamping section back surface 121 formed with mating grip arrays 143 implementing the grip feature 141. FIG. 32 shows the base member front surface 104 and the clamping section back surface 121 formed with spaced apart grip arrays 144 implementing the grip feature 141. FIG. 33 shows the clamping section back surface 121 formed with a bulbous end 146 implementing the grip feature 141.

Figure 34:
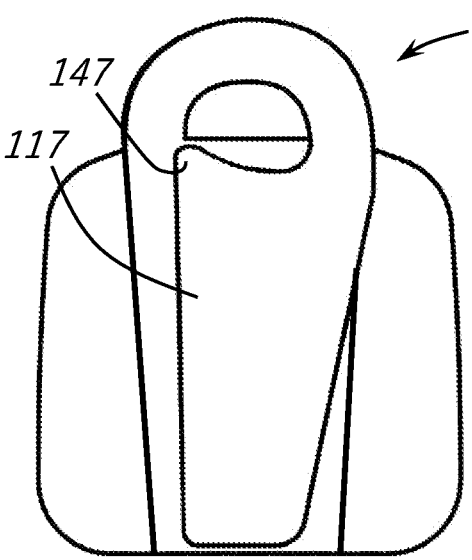
FIG. 34 to FIG. 41 are rear elevation views of key ring accessory devices with different shaped clamping members.
Figure 35:
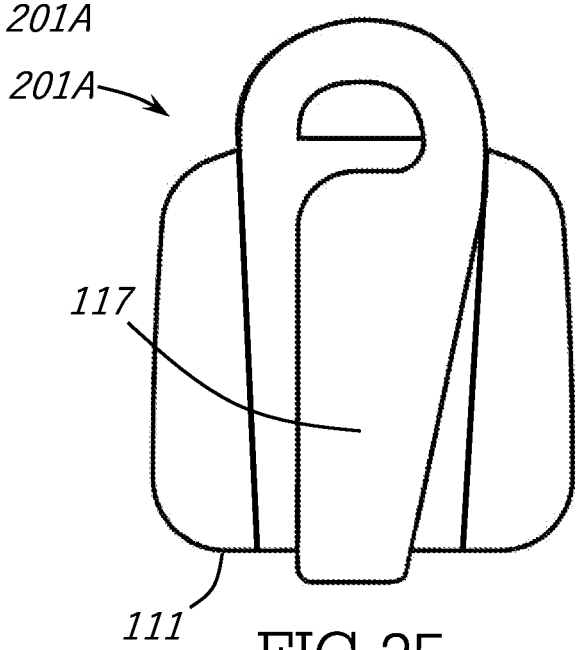
Figure 36:
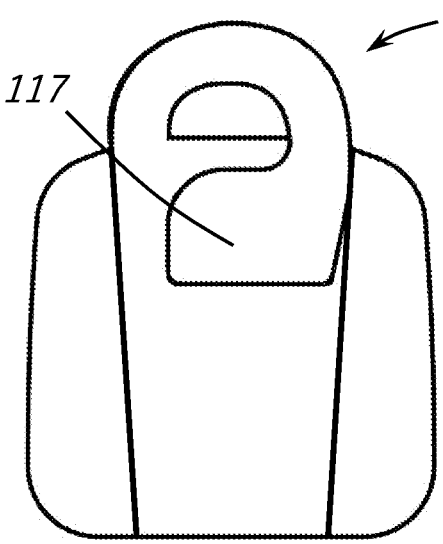
Figure 37:
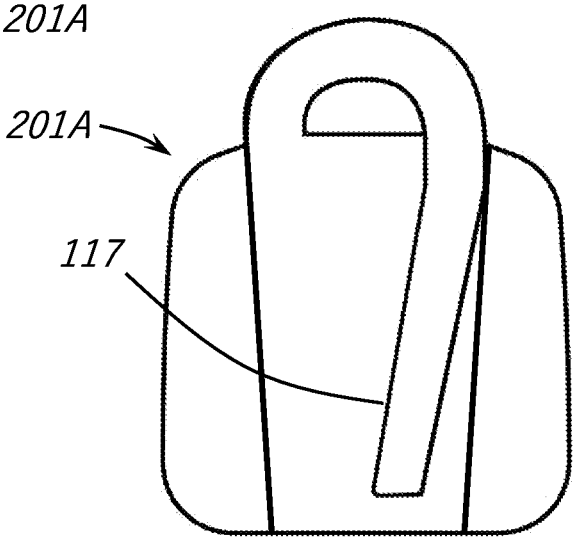
Figure 38:
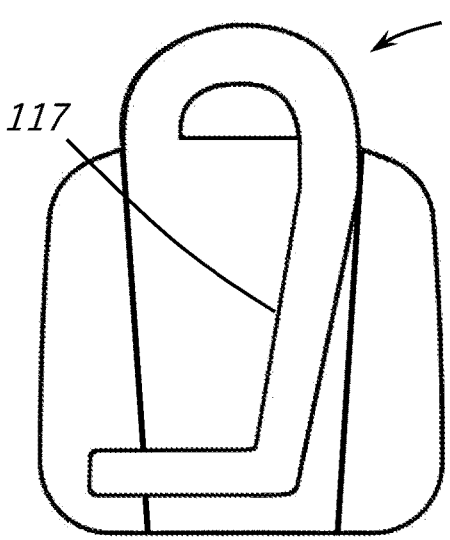
Figure 39:
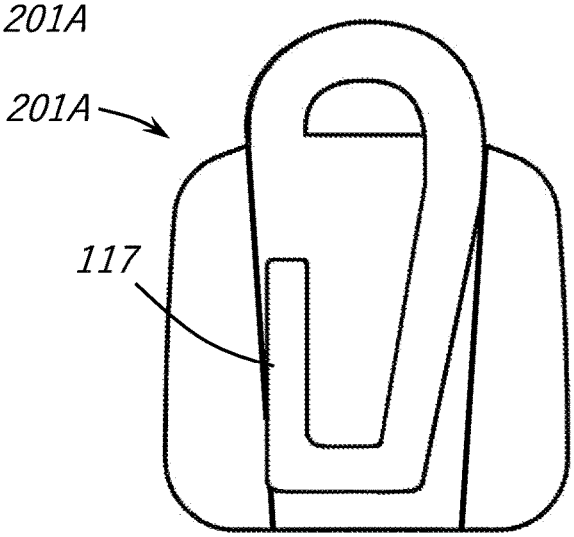
Figure 40:
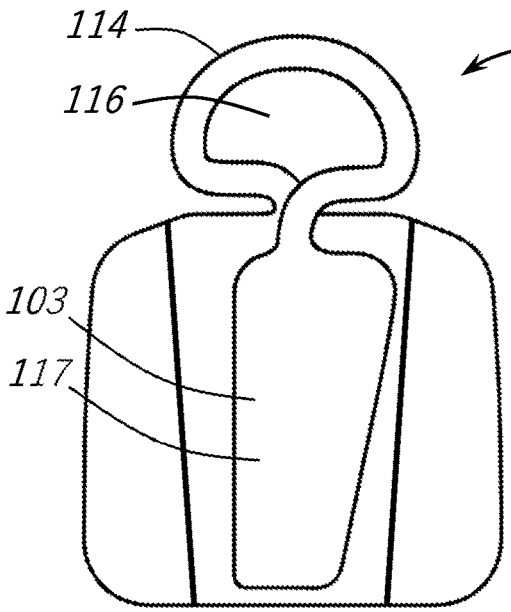
Figure 41:
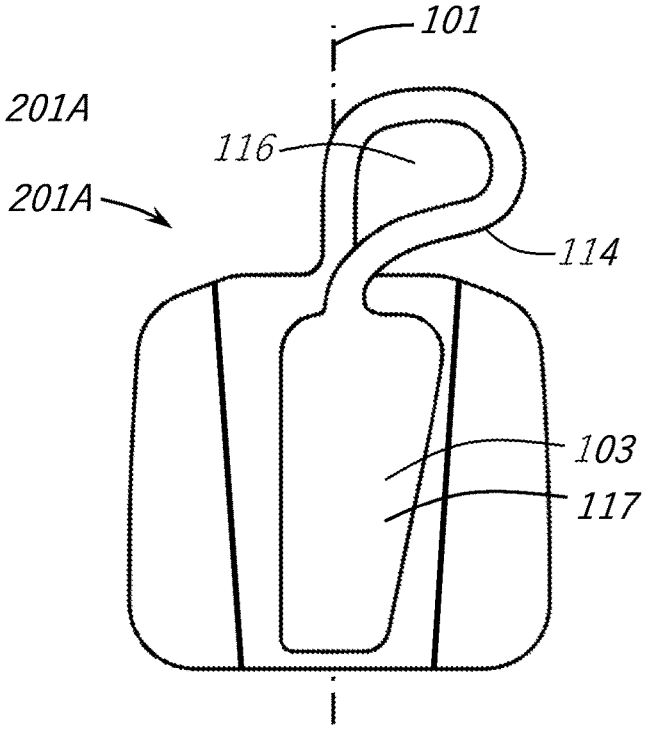

FIG. 34 to FIG. 41 show housings 201A with clamping sections 117 of different shapes and different lengths from a truncated length to being substantially co-extensive with a base member 102 as long as the key ring accessory devices 200A have a clamping zone sufficiently long for securely clipping on a clothing item. FIG. 34 shows a housing 201A with a clamping section 117 formed with a pointed clamping section uppermost side surface first end 147 for additional pegging a clothing item 400. FIG. 35 shows a housing 201A with a clamping section 117 which protrudes beyond the base member lowermost side surface 111. FIG. 36 shows a housing 201A with a truncated clamping section 117. FIG. 37 to FIG. 39 show housings 201A with strip-like clamping sections 117 compared to the FIG. 3 clamping section 117. FIG. 37 shows a straight strip-like clamping section 117. FIG. 38 shows a strip-like clamping section 117 with a transverse extension. FIG. 39 shows a strip-like clamping section 117 with an L-shaped extension to assume an overall hook appearance. FIG. 40 and FIG. 41 show clamping members 103 with bridge sections 114 which are employed for forming a throughgoing retaining aperture 116 having a closed shape in the housing 201A's front elevation view facing the clamping section 117. FIG. 41 shows a throughgoing retaining aperture 116 asymmetrical with respect to the longitudinal spring clip centerline 101.

While particular embodiments of the present invention are illustrated and described, it would be obvious to those skilled in the art that various other changes and modifications can be made without departing from the spirit and scope of the invention.

The invention claimed is:

1. A key ring accessory device for being interchangeably either attached to a split ring of a key ring and detached therefrom or clipped on a clothing item and removed therefrom, the split ring bounding a split ring aperture having a split ring aperture plane, the clothing item having a clothing item hem, the key ring accessory device for use or integral with an accessory item comprising a spring clip having a longitudinal spring clip centerline and including:

a) an elongated planar base member having a base member front surface, a base member back surface, a pair of opposite spaced apart base member major side surfaces co-directional with said longitudinal spring clip centerline, and a pair of opposite spaced apart base member side surfaces transverse to said longitudinal spring clip centerline, said pair of opposite spaced apart base member side surfaces transverse to said longitudinal spring clip centerline including a base member uppermost side surface and a base member lowermost side surface; and b) a clamping member resiliently flexibly connected to said base member uppermost side surface and including:

a clamping section overlying said base member front surface to bound a clamping zone therebetween, said clamping section being viewable in a front elevation view of the spring clip thereby concealing said clamping zone therebehind, and a bridge section resiliently flexibly extending between said elongated planar base member and said clamping section, said bridge section having a bridge section first end and an opposite bridge section second end, said bridge section first end connected to said base member uppermost side surface and said bridge section second end connected to said clamping section, wherein said bridge section bounds a throughgoing retaining aperture spaced apart from said clamping zone, said throughgoing retaining aperture having a closed shape in said front elevation view of the spring clip; and the key ring accessory device, in use, being either i) freely suspended from the split ring on sliding insertion of the split ring between said base member and said clamping section into said throughgoing retaining aperture, or ii) clamped on the clothing item on sliding insertion of the clothing item hem between said base member and said clamping section through said clamping zone towards said bridge section.

2. The device according to claim 1 and further comprising a housing for entrapping a discrete accessory item.

3. The device according to claim 2 wherein said housing includes a slot for enabling sliding insertion of said accessory item inside said housing.

4. The device according to claim 2 wherein said housing is a dual component housing including a discrete first housing component and a discrete second housing component for mounting on said discrete first housing component for entrapping said accessory item inside said dual component housing.

5. The device according to claim 2 wherein said housing is a flip housing having a first housing component and a second housing component hingedly attached to said first housing component for entrapping said accessory item in said flip housing.

6. The device according to claim 2 wherein said housing includes a surface with a resiliently flexible rim for peripherally securing said accessory item in said housing.

7. The device according to claim 2 wherein said housing includes a closing element for preventing inadvertent opening of said housing.

8. The device according to claim 1 and further comprising a constraining arrangement for entrapping said clamping section therebetween thereby constraining movement of said clamping section towards said base member front surface and away therefrom.

9. The device according to claim 8 wherein said constraining arrangement includes a spaced apart pair of projections.

10. The device according to claim 8 wherein said constraining arrangement includes a recess.

11. The device according to claim 1 wherein said accessory item is from the following list of an electronic chip, a tag, a remote control, a tracker, a flash drive, an illumination device, a digital wallet, a digital signature device, a cold-storage device, an external battery, a bottle opener, a can opener, a RFID token, a NFC token, a minimarket cart release token, a mini speaker, a personal SOS alarm, a pocket tool and a lighter.

* * * * *